US010906048B1

(12) United States Patent
Huang et al.

(10) Patent No.: US 10,906,048 B1
(45) Date of Patent: Feb. 2, 2021

(54) PROCESS FOR MACROSCOPICALLY SEPARATING MACERAL CONCENTRATE FROM RAW COAL

(71) Applicant: Taiyuan University of Technology, Taiyuan (CN)

(72) Inventors: Wei Huang, Taiyuan (CN); Dong Wang, Taiyuan (CN); Jun Wang, Taiyuan (CN); Chunyan Tu, Taiyuan (CN); Litong Liang, Taiyuan (CN); Zeyu Peng, Taiyuan (CN)

(73) Assignee: Taiyuan University of Technology, Taiyuan (CN)

( * ) Notice: Subject to any disclaimer, the term of this patent is extended or adjusted under 35 U.S.C. 154(b) by 0 days.

(21) Appl. No.: 16/879,737

(22) Filed: May 20, 2020

(30) Foreign Application Priority Data

Jul. 18, 2019 (CN) ..... 2019 1 0651214

(51) Int. Cl.

| | |
|---|---|
| ***B03D 1/02*** | (2006.01) |
| ***B03B 5/32*** | (2006.01) |
| ***B03B 7/00*** | (2006.01) |
| ***B03B 9/00*** | (2006.01) |
| ***B03B 5/34*** | (2006.01) |

(52) U.S. Cl.
CPC ..... *B03B 7/00* (2013.01); *B03B 5/34* (2013.01); *B03B 9/005* (2013.01); *B03D 1/02* (2013.01); *B03D 2201/02* (2013.01); *B03D 2201/04* (2013.01)

(58) Field of Classification Search
CPC .. B03D 1/02; B03D 2201/04; B03D 2201/02; B03B 7/00; B03B 9/005; B03B 5/34
USPC ..... 209/164, 166, 12.1, 17
See application file for complete search history.

(56) References Cited

U.S. PATENT DOCUMENTS 4,338,188 A * 7/1982 Guerre ..... B03B 5/34 209/172.5
4,543,104 A * 9/1985 Brown, Jr. ..... B03B 1/00 201/17

FOREIGN PATENT DOCUMENTS

| | | | |
|---|---|---|---|
| AU | 28471/92 B | * | 7/1993 |
| CN | 102627977 A | * | 8/2012 |
| CN | 104280284 A | * | 1/2015 |
| CN | 104437831 A | * | 3/2015 |
| CN | 106669960 A | * | 5/2017 |
| GB | 1130339 | * | 1/1966 |

* cited by examiner

*Primary Examiner* — Thomas M Lithgow
(74) *Attorney, Agent, or Firm* — Avant Law Group, LLC

(57) ABSTRACT

Processes for macroscopically separating a maceral concentrate from raw coal are disclosed. In some embodiments, a process includes the following steps: crushing and sieving the raw coal to obtain a first coal sample and a second coal sample; subjecting the first coal sample to a heavy medium cyclone separation process; and subjecting the second coal sample to a froth flotation process. The first coal sample has a particle size within a first particle size range, and the second coal sample has a particle size within a second particle size range. In other embodiments, the froth flotation process uses a froth flotation agent including a foaming agent and a collector. The foaming agent includes at least one item selected from the group consisting of 2-octanol, terpenic oil, and polyethylene glycol (PEG). The collector includes at least one item selected from the group consisting of kerosene, diethyl phthalate (BET), and diesel.

5 Claims, 1 Drawing Sheet

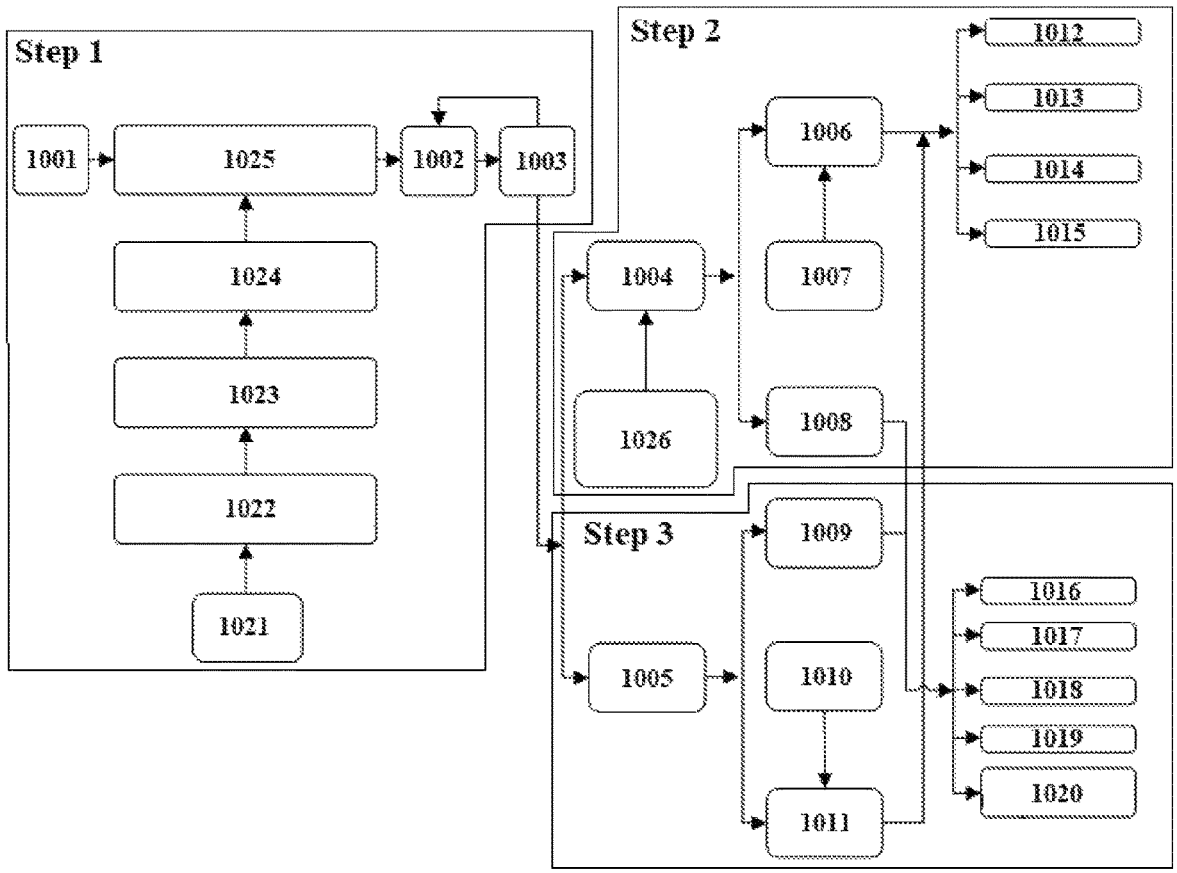
Step 1
1001
1025
1002
1003
1024
1023
1022
1021
Step 2
1006
1007
1004
1026
1008
1012
1013
1014
1015
Step 3
1009
1005
1010
1011
1016
1017
1018
1019
1020

PROCESS FOR MACROSCOPICALLY SEPARATING MACERAL CONCENTRATE FROM RAW COAL

CROSS REFERENCE TO RELATED APPLICATIONS

This application claims priority to Chinese application number 20191065121-4.8 filed on Jul. 18, 2019, the disclosure of which is incorporated by reference herein in its entirety.

FIELD OF THE DISCLOSURE

The disclosure relates generally to the field of coal separation. More specifically, the disclosure relates to the field of processes for macroscopically separating a maceral concentrate from raw coal.

BACKGROUND

Coal is a high-quality chemical raw material which includes abundant C, H, O, S, N, and even some rare elements. The latter play huge roles in producing important chemical products. In China, coal is usually directly combusted rather than indirectly used for producing chemical products. One of the reasons is that coal is a heterogeneous solid mixture with very complicated structures.

Coal is composed of organic compounds and inorganic minerals each with different components and properties. The organic compounds form different macerals in the coal. Different macerals have different structures and properties; as a result, their uses in coal processing and utilization are different. For example, vitrinite is largely used in coal blending, coking, liquefaction, et cetera. On the other hand, inertinite is a high-quality raw material for producing carbon materials in graphite and activated carbon even it has poor adhesion, slurry ability, and liquefaction.

Coal macerals has a wide range of applications in coal coking, coal liquefaction, coal combustion, coal water slurry (CWS), coal oxidation and gasification, primary sedimentary deposits, and biological mineralization. Therefore, studying the processing and utilization characteristics of coal macerals and developing the hierarchical utilization of coal macerals are effective ways to promote the comprehensive and efficient utilization of coal. However, the existing prior art such as iso-density gradient separation and electroflotation all have failed in the macro separation of coal macerals.

SUMMARY

The following presents a simplified summary of the invention in order to provide a basic understanding of some aspects of the invention. This summary is not an extensive overview of the invention. It is not intended to identify critical elements or to delineate the scope of the invention. Its sole purpose is to present some concepts of the invention in a simplified form as a prelude to the more detailed description that is presented elsewhere.

In some embodiments, the disclosure provides a process for macroscopically separating a maceral concentrate from raw coal. The process includes the following steps: (1) crushing and sieving the raw coal to obtain a first coal sample and a second coal sample; (2) subjecting the first coal sample to a heavy medium cyclone (HMC) separation process; and (3) subjecting the second coal sample to a froth flotation process. The first coal sample has a particle size within a first particle size range, and the second coal sample has a particle size within a second particle size range.

Optionally, the particle size of the first coal sample is greater than the particle size of the second coal sample.

Optionally, step (1) further includes the following steps: (1) sieving the crushed raw coal to at least five particle size ranges; (2) analyzing a maceral content of the sieved raw coal; and (3) determining the first particle size range and the second particle size range according to a maceral dissociation extent and a maceral content similarity of the raw coal within each particle size range.

Optionally, step (1) further includes the following steps: (1) sieving the crushed raw coal to at least seven particle size ranges; and (2) determining the first particle size range and the second particle size range according to a maceral dissociation extent and a maceral content similarity of the raw coal within each particle size range. The seven particle size ranges are: >4 mm, 4-2 mm, 2-1 mm, 1-0.5 mm, 0.5-0.2 mm, 0.2-0.074 mm, and <0.074 mm.

Optionally, the first particle size range is 0.2-2 mm.

Optionally, the second particle size range is 0-0.2 mm.

Optionally, the HMC separation process includes a concentration separation stage and a fine separation stage.

Optionally, the HMC separation process further includes the following steps: (1) sending first coal sample into a first HMC with a separation density of 1.30-1.45 g/cm$^3$ so that vitrinite concentrates as a first overflow; and (2) sending a first underflow of the first HMC into a second HMC with a separation density of 1.45-1.55 g/cm$^3$ so that inertinite concentrates as a second overflow.

Optionally, the first HMC has a separation density of 1.40 g/cm$^3$ and the second HMC has a separation density of 1.55 g/cm$^3$.

Optionally, the froth flotation process uses a froth flotation agent including a foaming agent and a collector; the foaming agent includes at least one item selected from the group consisting of 2-octanol, terpenic oil, and polyethylene glycol (PEG); and the collector includes at least one item selected from the group consisting of kerosene, diethyl phthalate (BET), and diesel.

BRIEF DESCRIPTION OF THE DRAWINGS

Illustrative embodiments of the present disclosure are described in detail below with reference to the figures.

The FIGURE shows a flowchart of a process for macroscopically separating a maceral concentrate from raw coal according to an embodiment of the disclosure.

DETAILED DESCRIPTION

The following describes some non-limiting embodiments of the invention with reference to the accompanying drawings. The described embodiments are merely a part rather than all of the embodiments of the invention. All other embodiments obtained by a person of ordinary skill in the art based on the embodiments of the disclosure shall fall within the scope of the disclosure.

The FIGURE shows a flowchart of a process for macroscopically separating a maceral concentrate from raw coal according to an embodiment of the disclosure. As shown in the FIGURE, a process for macroscopically separating a maceral concentrate from raw coal may include the following steps: Step 1, crushing and sieving the raw coal to obtain a first coal sample and a second coal sample; Step 2, subjecting the first coal sample to heavy medium cyclone (HMC) separation; and Step 3, subjecting the second coal sample to froth flotation. Here, the first coal sample may have a particle size falling within a first particle size range, and the second coal sample may have a particle size falling within a second particle size range As further shown in the FIGURE, 1001 represents coal, 1002 represents coal mill, 1003 represents sieving device, 1004 represents heavy medium cyclone (HMC), 1005 represents froth floatation device, 1006 represents vitrinite concentrate, 1007 represents exinite concentrate, 1008 represents inertinite concentrate, 1009 represents inertinite concentrate, 1010 represents exinite concentrate, 1011 represents vitrinite concentrate, 1012 represents asphalt, 1013 represents liquefaction, 1014 represents gasification, 1015 represents pyrolysis tar, 1016 represents pyrolysis tar, 1017 represents asphalt, 1018 represents graphite, 1019 represents activated carbon, 1020 represents other carbon products, 1021 represents raw coal sampling, 1022 represents crushing and sieving for different particle size ranges, 1023 represents maceral content analysis for different particle size ranges, 1024 represents particle size distribution of coal mill, 1025 represents determination of optimal dissociation particle size, and 1026 represents determination of optimal separation density.

Optionally, the particle size of the first coal sample may be greater than the particle size of the second coal sample. In other words, the particle size of the first coal sample may be greater than an upper limit of the second particle size range, or the particle size of the second coal sample may be smaller than a lower limit of the first particle size range.

The FIGURE shows a flowchart of the process for macroscopically separating a maceral concentrate from raw coal. As shown in the FIGURE, the raw coal may be firstly crushed by a coal mill 1002, and then sieved by a sieving device 1003. An oversized material may be subjected to an HMC separation in 1004, and an undersized material may be subjected to a froth flotation in 1005. A vitrinite concentrate 1006, an exinite concentrate 1007, and an inertinite concentrate 1008 may be obtained through the HMC separation in 1004. Similarly, a vitrinite concentrate 1011, an exinite concentrate 1010, and an inertinite concentrate 1009 may be obtained through the froth flotation in 1005. The vitrinite concentrate 1006 obtained through the HMC separation in 1004 and the vitrinite concentrate 1011 obtained through the froth flotation in 1005 may be used for asphalt manufacturing 1012, liquefaction 1013, gasification 1014, and/or pyrolysis tar preparation 1015. The inertinite concentrate 1008 obtained through the HMC separation in 10014 and the inertinite concentrate 1009 obtained through the froth flotation in 1005 may be used for preparing graphite 1018, activated carbon 1019, pyrolysis tar 1016, asphalt 1017, and/or other carbon products 1020. Optionally, the content of exinite may be very small in some types of coal, therefore, exinite may be incorporated into the vitrinite concentrates in some embodiments of the disclosure.

Coal is a very complex mixture, and there are large differences in the properties of coal, macerals, grindability, and the dissociation particle size of macerals in various regions. In order to ensure the economic efficiency and stability of macroscopic separation, it is necessary to dissociate the coal macerals and determine the optimal crushing particle size range of the raw coal (i.e. determine the first particle size range and/or the second particle size range).

In some embodiments, a process for macroscopically separating a maceral concentrate from raw coal may further include determining an optimal dissociation particle size and analyzing a maceral content in each particle size range after the raw coal is crushed. In some embodiments, a process for macroscopically separating a maceral concentrate from raw coal may further include determining an optimal dissociation particle size and analyzing a maceral content in each particle size range after the raw coal is crushed.

Optionally, after the raw coal is crushed, at least five particle size ranges may be divided for a maceral content analysis. The first particle size range and the second particle size range may be determined according to a maceral dissociation extent and a content similarity of the coal sample within each particle size range. In other words, the maceral content may be analyzed and compared, and a particle size range with a similar maceral content may be selected for statistical combination to determine the first particle size range and the second particle size range.

Optionally, after the raw coal is crushed, at least seven particle size ranges may be divided for a maceral content analysis. The first particle size range and the second particle size range may be determined according to a maceral dissociation extent and a content similarity of the coal sample within each particle size range.

Optionally, the seven particle size ranges may be >4 mm, 4-2 mm, 2-1 mm, 1-0.5 mm, 0.5-0.2 mm, 0.2-0.074 mm and <0.074 mm. In other words, the raw coal is sampled and crushed to <4 mm. Coal samples are respectively selected from the seven particle size ranges (>4 mm, 4-2 mm, 2-1 mm, 1-0.5 mm, 0.5-0.2 mm, 0.2-0.074 mm and <0.074 mm) for a maceral content analysis.

In other embodiments, the process may further include analyzing particle size distribution of the coal mill. Such analysis may include the following steps: raw coal sampling, crushing and sieving for different particle size ranges, maceral content analysis for respective particle size ranges, particle size distribution of coal mill, and determination of optimal dissociation particle size.

The above seven particle size ranges may be taken as an example to further explain the maceral content analysis. Here, following Table 1 shows the maceral data of a coal sample from Shaanxi Province in China.

TABLE 1

Content of mineral-based macerals

| SN | Coal Size (mm) | Vitrinite | Inertinite | Exinite | Mineral |
|---|---|---|---|---|---|
| 1 | Raw coal (dry) | 54.0 | 35.2 | 0.0 | 10.8 |
| 2 | 4 | 55.0 | 38.2 | 0.8 | 6.0 |
| 3 | 4-2 | 52.0 | 38.8 | 0.4 | 8.8 |
| 4 | 2-1 | 50.2 | 42.2 | 0.0 | 7.6 |
| 5 | 1-0.5 | 53.2 | 32.0 | 0.8 | 14.0 |
| 6 | 0.5-0.2 | 56.8 | 31.2 | 0.8 | 11.2 |
| 7 | 0.2-0.074 | 52.8 | 38.8 | 0.0 | 8.4 |
| 8 | 0.074-0.043 | 52.9 | 32.4 | 0.0 | 14.7 |
| 9 | <0.043 | Sample size does not meet measurement conditions | | | |

As shown in Table 1, the vitrinite content in the particle size range 0.5-0.2 mm is the highest, indicating that the vitrinite has the best dissociation effect. The inertinite content in the particle size range 2-1 mm is the highest, indicating that the inertinite has the best dissociation effect. The mineral content in the particle size range 1-0.5 mm is higher, indicating that the mineral has a better dissociation effect. The particle size range <0.043 mm does not meet measurement conditions, so no maceral content was detected Next, Table 2 shows the particle size distribution of the coal mill based on an economical coal milling yield and an optimized condition.

TABLE 2

Particle size distribution of coal mill

| SN | Coal Size /mm | Coal Mass | Yield |
|---|---|---|---|
| 1 | >4 mm | 1.34 | 0.03% |
| 2 | 4-2 mm | 288.31 | 5.83% |
| 3 | 2-1 mm | 1414.50 | 28.60% |
| 4 | 1-0.5 mm | 1480.37 | 29.93% |
| 5 | 0.5-0.2 mm | 829.67 | 16.78% |
| 6 | 0.2-0.074 mm | 865.08 | 17.49% |
| 7 | 0.074-0.043 mm | 63.38 | 1.28% |
| 8 | <0.043 mm | 3.03 | 0.06% |
| 9 | Total | 4945.68 | 100.00% |

As shown in Table 2, the yields of the particle size ranges of 2-1 mm, 1-0.5 mm, and 0.5-0.2 mm account for 75.31% in total, indicating that the three particle size ranges may have better yields. Based on the maceral content analysis results provided in Table 1, it may be determined that the first particle size range is 2-0.2 mm and the second particle size range is <0.2 mm.

Therefore, in some embodiments, the first particle size range may be 0.2-2 mm. An upper limit may be set for the first particle size range, and a coal sample below the particle size standard (i.e. beyond the upper limit of the first particle size range) may be crushed and sieved again. Optionally, the second particle size range may be 0-0.2 mm. That is to say, the most suitable crushing particle size of the raw coal for HMC separation may be 0.2-2 mm, and the most suitable crushing particle size for froth flotation may be <0.2 mm. The vitrinite concentrate and the inertinite concentrate obtained under these particle size ranges may each have the highest purity.

The HMC separation may include sending a coal sample (i.e. the first coal sample) meeting the particle size range of HMC separation into two (or more) HMCs. Optionally, the HMC separation may include two stages—a concentration stage and a fine separation stage. The first coal sample may be firstly sent into a first HMC with an applicable particle size range of 0.2-2 mm and a separation density of 1.40 g/cm$^3$. In the first HMC, vitrinite may be concentrated as an overflow, and an underflow may be sent to a second HMC with an applicable particle size range of 0.2-2 mm and a separation density of 1.55 g/cm$^3$. In the second HMC, inertinite may be concentrated as an overflow, and an underflow may be sent out for treatment. The vitrinite concentrate and the inertinite concentrate obtained may be respectively treated and collected.

Optionally, the separation density of the HMC may be determined by a separation test with a zinc chloride heavy liquid including a self-made agent. Generally, the self-made agent may be added to form different stable densities of the zinc chloride heavy liquid, which may include, but are not limited to, 1.20, 1.30, 1.40, 1.50, 1.60, 1.70, and 1.80 g/cm$^3$. After the separation of the zinc chloride heavy liquid, coal samples of different densities may be obtained, and the maceral content of the coal samples concentrated and separated at different densities may be analyzed. Further, through the maceral content analysis, the density of the zinc chloride heavy liquid suitable for the concentration and separation of vitrinite from the coal sample may be 1.30-1.45 g/cm$^3$. In some examples, the optimal separation density may be 1.40 g/cm$^3$. The density of the zinc chloride heavy liquid suitable for the concentration and separation of inertinite from the coal sample may be 1.45-1.55 g/cm$^3$, and in some examples, the optimal separation density may be 1.55 g/cm$^3$.

Optionally, the froth flotation may use a froth flotation agent including a foaming agent and a collector. The foaming agent may include at least one item selected from the group consisting of 2-octanol, terpenic oil (2# oil), and polyethylene glycol (PEG). The collector may include at least one item selected from the group consisting of kerosene, diethyl phthalate (BET), and diesel. Further, the froth flotation agent may further include at least one item selected from the group consisting of a pH adjuster, an emulsifier, a flocculant, an accelerator, and a dispersant. The pH adjuster may be sodium carbonate, the emulsifier may be an RP emulsifier and/or a DR emulsifier, the flocculant may be polyacrylamide (PAM) or a derivative thereof, the accelerator may be a CG accelerator, the dispersant may be a soda and/or polyphosphate. The froth flotation may include sending a coal sample (i.e. the second coal sample) meeting the particle size range of the froth flotation to a froth flotation device to separate a vitrinite concentrate and an inertinite concentrate.

Optionally, in some examples, the method may further include determining a froth flotation condition. A flotation single-factor test may be carried out to study the air inflow, the dose of the foaming agent, the dose of the collector, and the speed of the froth flotation for the second coal sample. Some examples of the froth flotation condition determination are shown in the following Table 3.

TABLE 3

Single-factor flotation

| SN | Air Inflow (L/h) | Dose of Foaming Agent (g/h) | Dose of Collector (g/h) | Speed (r/min) |
|---|---|---|---|---|
| 1 | 40 | 0.06 | 0.4 | 1000 |
| 2 | 60 | 0.08 | 0.6 | 1200 |
| 3 | 80 | 0.1 | 0.8 | 1400 |
| 4 | 100 | 0.12 | 1 | 1600 |
| 5 | 120 | 0.14 | 1.2 | 1800 |

Based on the single-factor test results, a true density in a float may be close to a true density of pure vitrinite at a point of the best flotation effect of respective factors. In other words, when the final flotation single factors—the air inflow, the dose of the foaming agent, the dose of the collector, the speed and the dose of a surfactant—are 120 L/h, 0.1 g/L, 0.6 g/L and 1400 r/min, the vitrinite may have a higher content in the float and a better flotation effect.

TABLE 4

Levels for multi-factor orthogonal froth flotation test

| Level | Air Inflow (L/h) | Dose of Foaming Agent (g/h) | Dose of Collector (g/h) | Speed (r/min) |
|---|---|---|---|---|
| 1 | 40 | 0.06 | 0.4 | 1000 |
| 2 | 60 | 0.08 | 0.6 | 1200 |
| 3 | 80 | 0.1 | 0.8 | 1400 |
| 4 | 100 | 0.12 | 1 | 1600 |
| 5 | 120 | 0.14 | 1.2 | 1800 |

A plurality of multi-factor test combinations according to different levels are carried out. The effects of the multi-factor test combinations are compared to determine the optimal test conditions for the froth flotation.

TABLE 5

Multi-factor orthogonal froth flotation test

| SN | Air Inflow (L/h) | Dose of Foaming Agent (g/h) | Dose of Collector (g/h) | Speed (r/min) |
|---|---|---|---|---|
| 1 | Level 1 | Level 5 | Level 1 | Level 5 |
| 2 | Level 2 | Level 4 | Level 1 | Level 5 |
| 3 | Level 3 | Level 3 | Level 1 | Level 5 |
| 4 | Level 4 | Level 2 | Level 1 | Level 5 |
| 5 | Level 5 | Level 1 | Level 2 | Level 4 |
| 6 | Level 1 | Level 5 | Level 2 | Level 4 |
| 7 | Level 2 | Level 4 | Level 2 | Level 4 |
| 8 | Level 3 | Level 3 | Level 2 | Level 4 |
| 9 | Level 4 | Level 2 | Level 3 | Level 3 |
| 10 | Level 5 | Level 1 | Level 3 | Level 3 |
| 11 | Level 1 | Level 5 | Level 3 | Level 3 |
| 12 | Level 2 | Level 4 | Level 3 | Level 3 |
| 13 | Level 3 | Level 3 | Level 4 | Level 2 |
| 14 | Level 4 | Level 2 | Level 4 | Level 2 |
| 15 | Level 5 | Level 1 | Level 4 | Level 2 |
| 16 | Level 1 | Level 5 | Level 4 | Level 2 |
| 17 | Level 2 | Level 4 | Level 5 | Level 1 |
| 18 | Level 3 | Level 3 | Level 5 | Level 1 |
| 19 | Level 4 | Level 2 | Level 5 | Level 1 |
| 20 | Level 5 | Level 1 | Level 5 | Level 1 |

In some embodiments, the results of the multi-factor orthogonal flotation test in Table 3 and the true density show that the ninth test combination of factors may be the best. The air inflow, the dose of the foaming agent, the dose of the collector, and the speed for the test may be determined as 100 L/h, 0.08 g/L, 0.8 g/L, and 1400 r/min, respectively. In other words, the flotation effect may be the best under these determined conditions. The vitrinite may be concentrated in the float, and the inertinite may be concentrated in a sink. Optionally, the flotation agent determined may include the following components based on a total mass percentage: 20% of foaming 2-octanol, 20% of polyethylene glycol, 29% of kerosene, 25% of diesel, 1.8% of RP emulsifier, 1.5% of polyacrylamide (PAM) and derivative, 1.3% of CG accelerator, and 1.4% of polyphosphate.

Various embodiments of the disclosure may have one or more of the following effects.

In some embodiments, the disclosure may provide a process for macroscopically separating a maceral concentrate from raw coal, which may help to overcome shortcomings in the prior art.

In other embodiments, the disclosure may provide a process for macroscopically separating a maceral concentrate from raw coal. The process may combine the HMC separation with the froth flotation to implement the macroscopical separation of the maceral concentrate from the raw coal and may help to form a new technical route for the hierarchical classification and utilization of coal.

In further embodiments, if more particle size ranges are selected (the division is finer) in the disclosure, the obtained maceral content may be more accurate while the workload may become larger. As a result, the determination of the particle size range to be analyzed as shown in the disclosure may reduce the workload while ensuring accuracy.

In some embodiments, the disclosure may provide a process for macroscopically separating a maceral concentrate from raw coal. The process may combine the HMC separation with the froth flotation to implement the macroscopical separation of the maceral concentrate from the raw coal and may form a new technical route for the hierarchical classification and utilization of coal. The process may help to obtains a large amount of maceral concentrates and may provide a new technical route for the subsequent hierarchical classification and utilization of coal.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Unless indicated otherwise, not all steps listed in the various figures need be carried out in the specific order described.

The disclosure claimed is:

1. A process for macroscopically separating a vitrinite concentrate from an inertinite concentrate by treating raw coal, comprising the steps of:

(1) crushing and sieving the raw coal to obtain a first coal sample and a second coal sample, wherein the first coal sample has a particle size within a first particle size range of 0.2-2 mm, and the second coal sample has a particle size within a second particle size range of 0-0.2 mm;

(2) subjecting the first coal sample to a heavy medium cyclone (HMC) separation process to separate a first vitrinite concentrate from a first inertinite vitrinite concentrate; and (3) subjecting the second coal sample to a froth flotation process to separate a second vitrinite concentrate from a second inertinite concentrate.

2. The process of claim 1, wherein the HMC separation process comprises a concentration separation stage and a fine separation stage.

3. The process of claim 2, wherein the HMC separation process further comprises:

sending the first coal sample into a first HMC with a separation density of 1.30-1.45 g/cm$^3$ so that the first vitrinite concentrate separates as a first overflow; and sending a first underflow of the first HMC into a second HMC with a separation density of 1.45-1.55 g/cm$^3$ so that the first inertinite concentrate separates as a second overflow.

4. The process of claim 3, wherein the first HMC has a separation density of 1.40 g/cm$^3$ and the second HMC has a separation density of 1.55 g/cm$^3$.

5. The process of claim 1, wherein:

the froth flotation process uses a froth flotation agent comprising a foaming agent and a collector;

the foaming agent includes at least one item selected group consisting of 2-octanol, terpenic oil, and polyethylene glycol (PEG); and the collector includes at least one item selected group consisting of kerosene, diethyl phthalate (BET), and diesel.

* * * * *